US006200667B1

(12) United States Patent
Haruta et al.

(10) Patent No.: US 6,200,667 B1
(45) **Date of Patent: *Mar. 13, 2001**

(54) CLOTH FOR TEXTILE PRINTING, AND TEXTILE PRINTING PROCESS USING THE CLOTH AND PRINT OBTAINED THEREBY

(75) Inventors: Masahiro Haruta, Tokyo; Shoji Koike, Yokohama; Koromo Shirota, Kawasaki; Mariko Suzuki, Yokohama; Shinichi Hakamada, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/045,027

(22) Filed: Mar. 20, 1998

(30) Foreign Application Priority Data

Mar. 24, 1997 (JP) ..... 9-069809
Apr. 2, 1997 (JP) ..... 9-083913

(51) Int. Cl.[7] ..... D06P 1/38; B32B 9/00

(52) U.S. Cl. ..... 428/195; 428/196; 442/152; 8/478; 347/105; 427/288; 427/322

(58) Field of Search ..... 428/195, 411.1, 428/474.4, 704, 196; 442/69, 75, 121, 152; 8/445, 478; 347/105; 427/288, 322

(56) References Cited

U.S. PATENT DOCUMENTS

| | | | | |
|---|---|---|---|---|
| 3,637,340 | * | 1/1972 | Mollet et al. | 8/166 |
| 3,775,045 | * | 11/1973 | Buehler et al. | 8/15 |
| 4,273,129 | | 6/1981 | Boebel | 128/326 |
| 4,455,147 | * | 6/1984 | Lewis et al. | 8/471 |
| 4,636,223 | | 1/1987 | Mehl et al. | 8/471 |
| 4,722,739 | * | 2/1988 | Blanchard et al. | 8/597 |
| 4,723,129 | | 2/1988 | Endo et al. | 346/1.1 |
| 4,740,796 | | 4/1988 | Endo et al. | 346/1.1 |
| 5,019,133 | * | 5/1991 | Himeno et al. | 8/531 |
| 5,095,023 | * | 3/1992 | Burton | 514/356 |
| 5,348,557 | | 9/1994 | von der Eltz et al. | 8/188 |
| 5,500,668 | * | 3/1996 | Malhotra et al. | 347/105 |
| 5,584,918 | * | 12/1996 | Suzuki et al. | 106/22 R |
| 5,679,143 | * | 10/1997 | Looman | 106/20 R |
| 5,820,661 | * | 10/1998 | Gregory et al. | 106/31.48 |
| 5,858,514 | * | 1/1999 | Bowers | 428/195 |

FOREIGN PATENT DOCUMENTS

| | | |
|---|---|---|
| 2938766A1 | 4/1980 | (DE) . |
| 160767A1 | 11/1985 | (EP) . |
| 177111A2 | 4/1986 | (EP) . |
| 202856A1 | 11/1986 | (EP) . |
| 590397A1 | 4/1994 | (EP) . |
| 605730A1 | 7/1994 | (EP) . |
| 710740A1 | 5/1996 | (EP) . |
| 2031469 | 4/1980 | (GB) . |
| 49-36077 | 4/1974 | (JP) . |
| 54-59936 | 5/1979 | (JP) . |
| 61-055277 | 3/1986 | (JP) . |
| 61-231289 | 10/1986 | (JP) . |
| 63-6183 | 1/1988 | (JP) . |
| 63-168382 | 7/1988 | (JP) . |
| 4-153380 | 5/1992 | (JP) . |
| 8-120576 | 5/1996 | (JP) . |
| 8-127979 | 5/1996 | (JP) . |
| 9-208853 | 8/1997 | (JP) . |
| WO91/02837 | 3/1991 | (WO) . |

* cited by examiner

*Primary Examiner*—Marie Yamnitzky
(74) *Attorney, Agent, or Firm*—Fitzpatrick, Cella, Harper & Scinto

(57) ABSTRACT

A cloth for textile printing, wherein any of the following substances is present on the surface of or in the interior of the cloth, (a) a tertiary amine compound having either a carboxyl group or a sulfonic group in its molecule, or a salt thereof, (b) a compound having a carboxyl group and an amide group, or a salt thereof, and (c) a compound having a sulfonic group and an amide group, or a salt thereof.

6 Claims, 1 Drawing Sheet

FIGURE
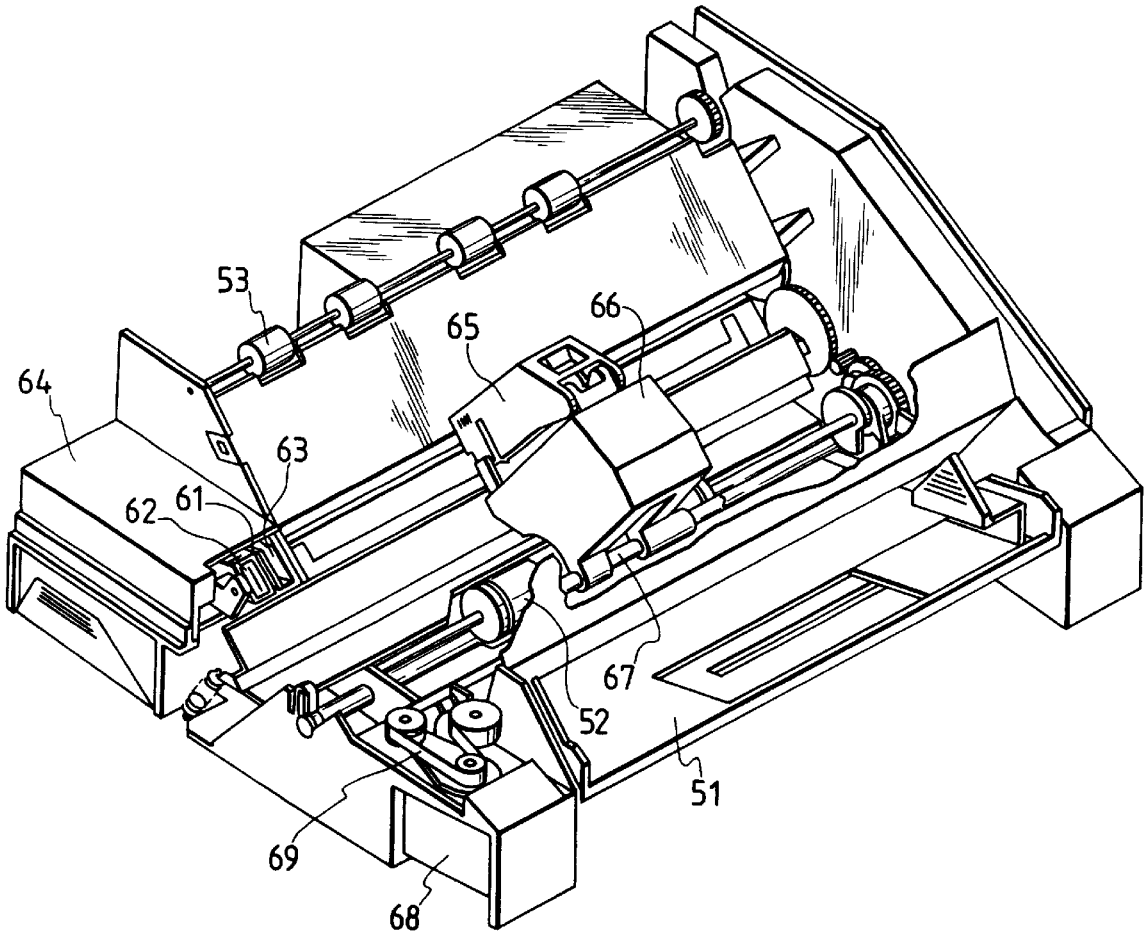

CLOTH FOR TEXTILE PRINTING, AND TEXTILE PRINTING PROCESS USING THE CLOTH AND PRINT OBTAINED THEREBY

BACKGROUND OF THE INVENTION

1. Field of the Invention

The present invention relates to a cloth suitable for use in printing using an ink-jet system, a textile printing process using this cloth, and a print obtained by such a process.

2. Related Background Art

As processes for conducting ink-jet printing on a cloth, there have heretofore been a process in which a cloth is temporarily adhered to a nonstretchable, flat support coated with an adhesive, to print the cloth by a printer (Japanese Patent Application Laid-Open No. 63-6183), a process in which a cloth pretreated with an aqueous solution containing any of a water-soluble polymeric substance, a water-soluble salt and water-insoluble inorganic fine particles, which all have color-fixing property to dyes used, is printed by an ink-jet system (Japanese Patent Publication No. 63-31594), a process in which cellulose fiber is pretreated with a solution containing an alkaline substance, urea or thiourea and a water-soluble polymeric substance, printed with inks containing a reactive dye by an ink-jet system and subjected to a fixing treatment under dry heat (Japanese Patent Publication No. 4-35351), etc.

Objects of these prior art processes are to prevent bleeding of images and provide a clear print having a sharp pattern and high optical density. However, these processes do not yet come to achieve the same color value and clearness as those of prints obtained by the conventional textile printing (screen printing). In addition, according to these processes, penetration of inks in the thickness direction of the cloth becomes poor, and so a problem of bleeding arises in the case where the depth in color is made high, or the amount of inks applied is great. Therefore, application fields of the resulting prints are limited.

SUMMARY OF THE INVENTION

It is therefore an object of the present invention to provide a cloth for textile printing, which permits the provision of a print having sufficiently high image optical density and depth in color and can prevent occurrence of bleeding to the utmost even when the amount of inks applied is great, a textile printing process using the cloth, and a print obtained by this process.

The above object can be achieved by the present invention described below.

According to the present invention, there is thus provided a cloth for textile printing, wherein any of the following substances is present on the surface of or in the interior of the cloth:

(a) a tertiary amine compound having either a carboxyl group or a sulfonic group in its molecule, or a salt thereof;

(b) a compound having a carboxyl group and an amide group, or a salt thereof; and (c) a compound having a sulfonic group and an amide group, or a salt thereof.

According to the present invention, there is also provided a textile printing process, comprising applying dyes to the cloth described above by an ink-jet system.

According to the present invention, there is further provided a print wherein any of the following substances, and dyes are present on the surface of or in the interior of the print:

(a) a tertiary amine compound having either a carboxyl group or a sulfonic group in its molecule, or a salt thereof;

(b) a compound having a carboxyl group and an amide group, or a salt thereof; and (c) a compound having a sulfonic group and an amide group, or a salt thereof.

According to the present invention, there is still further provided a pretreatment agent for textile printing, comprising water and any of the following substances:

(a) a tertiary amine compound having either a carboxyl group or a sulfonic group in its molecule, or a salt thereof;

(b) a compound having a carboxyl group and an amide group, or a salt thereof; and (c) a compound having a sulfonic group and an amide group, or a salt thereof.

BRIEF DESCRIPTION OF THE DRAWING

FIGURE is a perspective view illustrating an exemplary apparatus by which the textile printing process according to the present invention is performed.

DESCRIPTION OF THE PREFERRED EMBODIMENTS

The cloth for textile printing according to the present invention is obtained by applying a pretreatment agent to a cloth in advance for the purpose of enhancing the color-fixing property of fiber making up the cloth and drying the cloth. The pretreatment agent used in the present invention comprises water and any of the following substances:

(a) a tertiary amine compound having either a carboxyl group or a sulfonic group in its molecule, or a salt thereof;

(b) a compound having a carboxyl group and an amide group, or a salt thereof; and (c) a compound having a sulfonic group and an amide group, or a salt thereof.

The content of the substance (a), (b) or (c) in the pretreatment agent is preferably within a range of from 0.01 to 40% by weight, more preferably from 0.1 to 30% by weight, most preferably from 0.5 to 25% by weight.

The pretreatment agent is applied to a cloth in advance and the cloth is dried, whereby the substance (a), (b) or (c) comes to be present on the surface of or in the interior of the cloth. A pickup upon the application of the pretreatment agent to the cloth is preferably 50 to 150%.

Incidentally, the pickup (%) in the present invention was determined in accordance with the equation $$\text{Pickup (\%)}=\{(\text{Weight of the pretreatment agent applied})/(\text{Weight of the cloth})\}\times 100.$$

Preferable examples of the substance (a) include pyridine-3-carboxylic acid, dimethylglycine, bishydroxyethyltaurine, and alkali metal salts and organic amine salts thereof.

Preferable examples of the substance (b) include pyrrolidone-5-carboxylic acid, hippuric acid, glutamic acid, and alkali metal salts and organic amine salts thereof.

Preferable examples of the substance (c) include benzoyltaurine, and alkali metal salts and organic amine salts thereof.

The sodium salts are preferably used as the alkali metal salts. Besides, salts with ammonium, alkylamine or hydroxyalkylamine are used as the organic amine salts, with the triethanolamine salt being particularly preferred.

The content of the substance (a), (b) or (c) in the cloth is preferably within a range of from 0.1 to 40% by weight, more preferably from 0.3 to 30% by weight.

It is more preferable that the cloth should contain a water repellent or a water-soluble resin or both thereof, which serve to prevent bleeding of inks and retain dyes on the surface of the cloth to enhance the coloring ability of inks applied, and a nonionic surfactant or anionic surfactant serving to prevent liquid media in inks from excessively penetrating in the thickness direction of the cloth and improve the wettability of dyes with the cloth in addition to the substance (a), (b) or (c).

The water repellent used in the present invention may be any substance so far as it is a hydrophobic substance and has a nature to repel water. However, specific examples thereof include fluorine compounds, silicon compounds, waxes, triazine compounds, rosin size and mixtures thereof. Of these, emulsions of waxes are preferred from the viewpoints of prevention of bleeding and improvement in color value.

The amount of the water repellent applied to the cloth in the present invention is preferably within a range of from 0.05 to 40% by weight, more preferably from 0.1 to 30% by weight. If the amount of the water repellent applied to the cloth is lower than 0.05% by weight, its effect to retain dyes on the surface of the cloth to enhance the coloring ability of inks applied cannot be exhibited. If the amount exceeds 40% by weight on the other hand, lowering of the effect is caused. It is hence not preferable to use the water repellent outside the above range.

Examples of the water-soluble resin used in the present invention include carboxymethyl cellulose, tragacanth gum, guar gum, starch, sodium alginate, polyethylene oxide, polyvinyl pyrrolidone, polyvinyl methyl ether, polyvinyl alcohol, sodium polyacrylate and polyacrylamide. Of these, those having a weight average molecular weight of about 100,000 to 2,500,000 are preferred.

Examples of such preferable water-soluble resins include polyethylene oxide, polyvinyl pyrrolidone, polyvinyl methyl ether, polyvinyl alcohol, sodium polyacrylate and polyacrylamide. In particular, polyethylene oxide is more preferably used. The amount of the water-soluble resin applied to the cloth is preferably within a range of from 0.1 to 40% by weight, more preferably from 0.3 to 30% by weight.

If the amount of the water-soluble resin applied to the cloth is lower than 0.1% by weight, its effect to prevent bleeding of inks cannot be exhibited. If the amount exceeds 40% by weight on the other hand, a problem of lowering coloring efficiency is caused. It is hence not preferable to use the water-soluble resin outside the above range.

Examples of the nonionic surfactant used in the present invention include hexaglyceryl monolaurate, polyoxyethylene sorbitan monopalmitate (20 EO), polyoxyethylene sorbit tetraoleate (40 EO), polyethylene glycol distearate, polyoxyethylene hardened castor oil (50 EO), polyoxyethylene oleyl ether (50 EO), polyoxyethylene-polyoxypropylene cetyl ether (20 EO, 4 PO), polyoxyethylene nonyl phenyl ether (20 EO), acetylene glycol polyoxyethylene (10 EO) and acetylene glycol polyoxyethylene (30 EO). Examples of the anionic surfactant include potassium oleate, sodium lauryl sulfate, sodium dodecylbenzenesulfonate, sodium methyl-naphthalenesulfonate, sodium polyoxyethylene alkyl phenyl ether sulfate and sodium dialkylsulfosuccinate.

These surfactants are preferably applied to the cloth in an amount of 0.01 to 40% by weight, more preferably 0.01 to 30% by weight. If the amount of the surfactants is lower than 0.01% by weight, the penetrating action of liquid media in inks in the thickness direction of the resulting cloth and the coloring action of dyes on the resulting cloth are rendered insufficient. If the amount exceeds 40% by weight on the other hand, the bleeding of inks applied to the resulting cloth is rather increased. It is hence not preferable to use the surfactants outside the above range.

Among the above-described surfactants, nonionic surfactants having an HLB of 12 to 20 inclusive are preferred.

In order to enhance coloring ability and the effect to prevent bleeding when textile printing is conducted by an ink-jet system, a water-soluble inorganic salt, pH adjustor, hydrotropic agent, chelating agent, hydrophilic resin and/or the like may be further added. The amount of these additives added varies according to the kinds thereof. However, it is preferably within a range of from 0.05 to 10% by weight based on the total weight of an aqueous slurry as the pretreatment agent.

Examples of the water-soluble inorganic salt include potassium sulfate, sodium sulfate, magnesium sulfate, sodium chloride and sodium bromide. An alcohol may be suitably chosen for use as an aqueous solvent.

Specific examples of the pH adjustor include phosphoric acid, boric acid, silicic acid, carbonic acid, acetic acid, citric acid, tartaric acid, maleic acid, fumaric acid, and alkali metal, ammonium, triethylamine and triethanolamine salts of these acids, as well as sodium hydroxide and triethanolamine.

Examples of the hydrotropic agent include urea, thiourea, and examples of the chelating agent include the sodium salts of tannic acid, lignin sulfonic acid and EDTA, and examples of the hydrophilic resin include starch, methyl cellulose, CMC, polyethyleneimine and polyarylamine.

In the present invention, various kinds of cloths may be used as a base cloth. Examples thereof include cloths separately made of cotton, silk, hemp, nylon, rayon, acetate, polyester and mixed fibers thereof. The pH of the pretreatment agent has an optimum value according to the kind of these cloths. For example, cotton, silk, hemp and rayon cloths are treated with a pretreatment agent adjusted to an alkaline pH with sodium hydrogencarbonate or sodium carbonate and then printed with reactive dyes. A nylon cloth is treated with a pretreatment agent adjusted to an acidic pH and then printed with acid dyes.

On the other hand, acetate and polyester cloths are preferably treated with a pretreatment agent adjusted to a substantially neutral pH.

The textile printing process of the present invention is a process in which dyes are applied to the cloth for textile printing according to the present invention by an ink-jet system.

Inks usable in the present invention may be inks containing any of reactive dyes, acid dyes, direct dyes and disperse dyes. However, inks containing the most suitable dye according to the kind of a cloth used may preferably be used.

The printing may be conducted by scanning a head of an ink-jet printer on the cloth according to the present invention to apply inks after an image pattern. After the printing, the cloth is subjected to a heating or steaming treatment as needed, washed and then dried, thereby achieving the object.

As the heating or steaming treatment, the conventional technique, for example, a known process performed in a textile printing process may be suitably used as it is. Namely a high-temperature steaming process or thermosol process is used. Actual treatment conditions vary according to the kind of a cloth used. In the case where a cotton or silk cloth is printed with inks containing a reactive dye, the treatment is conducted at 100 to 105° C. for 5 to 30 minutes in accordance with the high-temperature steaming process. In the case where a polyester cloth is printed with inks containing a disperse dye, the treatment is conducted at 160 to 180° C. for several minutes to several tens minutes in accordance with the high-temperature steaming process or at 190 to 230° C. for several seconds to several tens seconds in accordance with the thermosol process.

After the dyeing treatment, the printed cloth is washed. In general, washing with water and soaping with an aqueous solution containing an alkaline agent are conducted. In the case of a polyester cloth, it is normal to conduct reductive washing with an aqueous solution containing an alkaline agent and hydrosulfite after washing with water and then carry out additional washing with water.

As components of inks for ink-jet printing used in the ink-jet printing process according to the present invention, may be suitably used a dye, water, water-soluble organic solvent, pH adjustor, mildewproofing agents, surfactant, dispersing agent, water-soluble resin and the like. As the dye, may be used any of acid dyes, direct dyes, basic dyes, reactive dyes, disperse dyes and pigments.

Examples of the water-soluble organic solvent include glycols, glycol ethers, nitrogen-containing solvents and alcohols. As examples of usable surfactants, may be mentioned all of nonionic, anionic, cationic and amphoteric surfactants. These surfactants are each properly used as necessary for the end application intended. Besides, a hydrotropic agent such as urea may be used.

In order to use inks containing a disperse dye, the dispersing agent is used. Specific examples thereof include lignin sulfonates, naphthalenesulfonic acid-formalin condensates and polyoxyethylene monophenyl ether.

The ink-jet system used in the textile printing process according to the present invention may be any conventionally-known ink-jet recording system. However, the method described in Japanese Patent Application Laid-Open No. 54-59936, i.e., a system in which thermal energy is applied to an ink so as to undergo a rapid volume change, and the ink is ejected from a nozzle by action force caused by this change of state, is an effective method. The reason for it is that when a printing head having a plurality of nozzles is used, the above system can make a scatter of ejection velocities of inks among the nozzles narrow, and so the ejection velocities of the inks can be focused within a range of from 5 to 20 m/sec. When an ink containing a dye strikes a cloth at a velocity within this range, the state of penetration of the ink droplet into the fiber of the cloth becomes optimum at the time the ink has been applied.

With respect to the typical construction and principle thereof, an apparatus using the basic principle disclosed in, for example, U.S. Pat. Nos. 4,723,129 and 4,740,796 is preferred. This system may be applied to both so-called On-Demand type and continuous type. However, it is particularly effective to apply it to the On-Demand type, because at least one drive signal corresponding to recording information, to the effect that rapid temperature rise exceeding nuclear boiling is given, is applied to an electrothermal energy converter arranged in opposed relation to a sheet in which a liquid (ink) is held, or a flow path of the ink, whereby the electrothermal energy converter generates thermal energy to cause film boiling on a surface of a recording head, on which heat has acted, and consequently a bubble can be formed in the liquid (ink) in response to this drive signal. By growth and contraction of this bubble, the liquid (ink) is ejected through an ejection orifice to form at least one droplet of the liquid (ink).

In addition, as a full-line type recording head having a length corresponding to the width of the largest cloth printable by a printing apparatus, there may be adopted a construction that the length is satisfied by a combination of plural recording heads, or a construction that a recording head is integrally formed.

In the above description, the inks have been described as liquid. However, the inks may be solidified at room temperature or lower and softened or liquefied at a temperature higher than room temperature.

As conditions under which a printing process having a particularly high effect can be attained, it is preferred that an ejected ink droplet be within a range of from 20 to 200 pl, a shot-in ink quantity be within a range of from 4 to 40 nl/mm$^2$, a drive frequency be at least 1.5 kHz, and a head temperature be within a range of from 35 to 60° C.

As an example of an apparatus suitable for use in performing the textile printing process according to the present invention, may be mentioned an apparatus in which thermal energy in response to a printing signal is applied to an ink within a printing head, and an ink droplet is generated by the thermal energy. This apparatus will hereinafter be described.

The FIGURE illustrates an example of such an ink-jet printing apparatus.

In the FIGURE, reference numeral 61 designates a blade serving as a wiping member, one end of which is a stationary end held by a blade-holding member to form a cantilever. The blade 61 is provided at the position adjacent to the region in which a printing head operates, and in this embodiment, is held in such a form that it protrudes into the course through which the printing head is moved. Reference numeral 62 indicates a cap, which is provided at the home position adjacent to the blade 61, and is so constructed that it moves in the direction perpendicular to the direction in which the printing head is moved and comes into contact with the face of ejection openings to cap it. Reference numeral 63 denotes an absorbing member provided adjoiningly to the blade 61 and, similar to the blade 61, held in such a form that it protrudes into the course through which the printing head is moved. The above-described blade 61, cap 62 and absorbing member 63 constitute an ejection-recovery portion 64, where the blade 61 and absorbing member 63 remove water, dust and/or the like from the face of ink-ejecting openings.

Reference numeral 65 designates the printing head having an ejection-energy-generating means and serving to eject the ink onto a cloth set in an opposing relation to an ejection opening face provided with the ejection openings to conduct printing. Reference numeral 66 indicates a carriage on which the printing head 65 is mounted so that the printing head 65 can be moved. The carriage 66 is slidably interlocked with a guide rod 67 and is connected (not illustrated) at its part to a belt 69 driven by a motor 68. Thus, the carriage 66 can be moved along the guide rod 67 and hence, the printing head 65 can be moved from a printing region to a region adjacent thereto.

Reference numerals 51 and 52 denote a cloth feeding part from which cloths are separately inserted, and cloth feed rollers driven by a motor (not illustrated), respectively. With such a construction, the cloth is fed to the position opposite to the ejection opening face of the printing head 65, and discharged from a cloth discharge section provided with cloth discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement.

The above movement of the printing head 65 to its home position is made not only when the printing is completed or the printing head 65 is recovered for ejection, but also when the printing head 65 is moved between printing regions for the purpose of printing, during which it is moved to the home position adjacent to each printing region at given intervals, where the ejection opening face is wiped in accordance with this movement.

The present invention will hereinafter be described more specifically by the following Examples and Comparative Examples. Incidentally, all designations of "part" or "parts" and "%" as will be used in the following examples mean part or parts by weight and % by weight unless expressly noted.

EXAMPLE 1

Four parts of dimethylglycine were mixed with 96 parts of water to obtain a pretreatment agent in the form of a solution. A nylon cloth was impregnated with this pretreatment agent (pickup: 90%) and then dried to obtain a cloth for ink-jet textile printing according to this example.

The thus-obtained cloth was cut into sizes of an A4 format, and multi-color printing is conducted on the cloth sample thus obtained by means of a commercially available ink-jet color printer (BJC-820J, trade name, manufactured by Canon Inc.) and commercially available inks for this printer. After completion of the printing, the printed cloth was immediately subjected to a steaming treatment at 102° C. for 30 minutes, washed with water for 10 minutes and then dried.

As a result, a color image having depth in color and a sufficient color value was clearly printed on the cloth. The print thus obtained had no stain on its white portion to which no ink was applied.

EXAMPLE 2

Four parts of the triethanolamine salt of pyridine-3-carboxylic acid were mixed with 3 parts of sodium hydrogencarbonate and 93 parts of water to obtain a pretreatment agent in the form of a solution. A plain weave cotton fabric having a thickness of 270 μm was impregnated with this pretreatment agent (pickup: 80%), dried and then cut into sizes of an A2 format to obtain a cloth according to this example.

Full-color printing was performed on the thus-obtained cloth according to this example by means of a commercially available ink-jet color printer (BJC-440, trade name, manufactured by Canon Inc.) and 4 kinds of inks having the following respective compositions. The four kinds of inks used were prepared by mixing and stirring the respective components, adjusting the resultant mixtures to pH 7.0 with sodium hydroxide and then filtering them through a Fluoropore filter.

| | |
|---|---|
| Cyan ink: | |
| C.I. Reactive Blue 15 | 11 parts |
| Thiodiglycol | 20 parts |
| Diethylene glycol | 15 parts |
| Ion-exchanged water | 54 parts. |
| Magenta ink: | |
| C.I. Reactive Red 226 | 9 parts |
| Thiodiglycol | 20 parts |
| Diethylene glycol | 10 parts |
| Ion-exchanged water | 61 parts. |
| Yellow ink: | |
| C.I. Reactive Yellow 95 | 9 parts |
| Thiodiglycol | 20 parts |
| Diethylene glycol | 15 parts |
| Ion-exchanged water | 56 parts. |
| Black ink: | |
| C.I. Reactive Black 39 | 13 parts |
| Thiodiglycol | 20 parts |
| Ethylene glycol | 15 parts |
| Ion-exchanged water | 52 parts. |

After completion of the printing, the printed cloth was immediately subjected to a steaming treatment at 102° C. for 8 minutes, washed with water and then dried. As a result, a color image having depth in color and a sufficient color value was clearly printed on the cotton cloth. The print thus obtained was free of any image irregularities and had no stain on its white portion to which no ink was applied.

EXAMPLE 3

A pretreatment agent was prepared by using 2.0 parts of the sodium salt of bishydroxyethyltaurine, 1.0 part of sodium alginate and 97 parts of water. A polyester cloth having a thickness of 200 μm was subjected to a padding treatment (pickup: 70%) with this pretreatment agent and then dried to obtain a cloth according to this example.

The thus-obtained cloth was cut into a rolled cloth 42 cm broad. Full-color printing was then performed on the thus-obtained rolled cloth by means of a commercially available ink-jet color printer (BJC-440, trade name, manufactured by Canon Inc.) and 4 kinds of inks having the following respective compositions and each containing a disperse dye. The four kinds of inks used were prepared by mixing and dispersing the respective components by means of a sand grinder and then filtering the dispersions through a filter.

| | |
|---|---|
| Cyan ink: | |
| C.I. Disperse Blue 87 | 6 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 58 parts. |
| Magenta ink: | |
| C.I. Disperse Red 92 | 5 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 59 parts. |

-continued

| | |
|---|---|
| Yellow ink: | |
| C.I. Disperse Yellow 93 | 5 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 59 parts. |
| Black ink: | |
| C.I. Disperse Black 1 | 6 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 58 parts. |

After completion of the printing, the printed portion was immediately cut out and subjected to a dyeing treatment for 7 minutes with superheated steam of 170° C. The thus-treated cloth portion was then subjected to reductive washing and water washing, and then dried. As a result, a color image having depth in color and a sufficient optical density was clearly printed on the polyester cloth. The print thus obtained was sharp in image and had no stain on its white portion to which no ink was applied.

EXAMPLE 4

A polyester satin fabric (thickness of fiber: 0.8 denier) was subjected to a padding treatment (pickup: 90%) with the same pretreatment agent as that used in Example 3 and then dried to obtain a cloth according to the present invention. After this, the cloth was treated in exactly the same manner as in Example 3 to obtain a final print.

As a result, a color image having depth in color and a sufficient color value was clearly printed on the polyester satin fabric. The print thus obtained was sharp in image and had no stain on its white portion to which no ink was applied.

EXAMPLE 5

Four parts of the triethanolamine salt of pyridine-3-carboxylic acid were mixed with 3.0 parts of Paragium SS (trade name, paraffin type water repellent, product of Ohara Palladium KK), 0.2 parts of Acetylenol EH (trade name, nonionic surfactant, product of Kawaken Fine Chemicals Co., Ltd.), 2.5 parts of sodium hydrogencarbonate and 90.3 parts of water to obtain a pretreatment agent in the form of a solution. A plain weave cotton fabric was impregnated with this pretreatment agent (pickup: 90%) and dried to obtain a cloth according to the present invention.

Multi-color printing was then performed on the thus-obtained cloth by means of the commercially available ink-jet color printer (BJC-440, trade name, manufactured by Canon Inc.) used in Example 2 and the same inks as those used in Example 2. After completion of the printing, the printed cloth was immediately subjected to a dyeing treatment for 8 minutes with superheated steam of 102° C., washed with water and then dried. As a result, an image higher in color value and sharper than the image in Example 2 was printed on the cotton cloth.

EXAMPLE 6

Two parts of sodium pyridine-3-carboxylate were mixed with 1.0 part of sodium alginate, 2.0 parts of sodium hydrogencarbonate, 0.2 parts of Acetylenol EH (trade name, nonionic surfactant, product of Kawaken Fine Chemicals Co., Ltd.) and 94.8 parts of water to obtain a pretreatment agent in the form of a solution. A silk cloth was subjected to a padding treatment (pickup: 90%) with this pretreatment agent and dried to obtain a cloth according to the present invention.

Multi-color printing was then performed on the thus-obtained cloth by means of the commercially available ink-jet color printer (BJC-440, trade name, manufactured by Canon Inc.) used in Example 2 and the same inks as those used in Example 2. After completion of the printing, the printed cloth was immediately subjected to a dyeing treatment for 8 minutes with superheated steam of 102° C., washed with water and then dried. As a result, a color image, which was free of any irregularities and had depth in color and a sufficient color value, was clearly printed on the silk cloth. The print thus obtained was sharp in image and had no stain on its white portion to which no ink was applied.

Comparative Example 1

A cloth for textile printing was prepared in the same manner as in Example 2 except that the triethanolamine salt of pyridine-3-carboxylic acid was not used. Multi-color printing was then performed on the thus-obtained cloth by means of a commercially available ink-jet color printer (BJC-440, trade name, manufactured by Canon Inc.). After completion of the printing, the printed cloth was treated in the same manner as in Example 2 to obtain a print.

As a result, a color image having somewhat dull color tone compared with the print obtained in Example 2 was printed on the cotton cloth. Any color image having depth in color and a sufficient color value could not be obtained.

Comparative Example 2

A nylon cloth for textile printing was prepared in the same manner as in Example 1 except that the pretreatment agent used in Example 1 was not used. Multi-color printing was then performed on the thus-obtained cloth by means of a commercially available ink-jet color printer (BJC-820J, trade name, manufactured by Canon Inc.). After completion of the printing, the printed cloth was treated in the same manner as in Example 1 to obtain a print.

As a result, an image printed on the nylon cloth lacked depth in color and had an insufficient optical density compared with the image in Example 1.

EXAMPLE 7

Two parts of pyrrolidone-5-carboxylic acid were mixed with 1.5 parts of triethanolamine and 96.5 parts of water to obtain a pretreatment agent in the form of a solution. A nylon cloth was impregnated with this pretreatment agent (pickup: 90%) and then dried to obtain a cloth for ink-jet textile printing according to this example.

The thus-obtained cloth was cut into sizes of an A4 format, and multi-color printing is conducted on the cloth sample thus obtained by means of a commercially available ink-jet color printer (BJC-820J, trade name, manufactured by Canon Inc.) and commercially available inks for this printer. After completion of the printing, the printed cloth was immediately subjected to a steaming treatment at 102° C. for 30 minutes, washed with water for 10 minutes and then dried.

As a result, a color image having depth in color and a sufficient color value was clearly printed on the cloth. The print thus obtained had no stain on its white portion to which no ink was applied.

EXAMPLE 8

Two parts of pyrrolidone-5-carboxylic acid were mixed with 2.0 parts of triethanolamine, 3.0 parts of sodium hydrogencarbonate and 93.0 parts of water to obtain a pretreatment agent in the form of a solution. A plain weave cotton fabric having a thickness of 270 μm was impregnated with this pretreatment agent (pickup: 80%), dried and then cut into sizes of an A2 format to obtain a cloth according to this example.

Full-color printing was performed on the thus-obtained cloth according to this example by means of a commercially available ink-jet color printer (BJC-440, trade name, manufactured by Canon Inc.) and 4 kinds of inks having the following respective compositions. The four kinds of inks used were prepared by mixing and stirring the respective components, adjusting the resultant mixtures to pH 7.0 with sodium hydroxide and then filtering them through a Fluoropore filter.

| | |
|---|---|
| Cyan ink: | |
| C.I. Reactive Blue 15 | 11 parts |
| Thiodiglycol | 20 parts |
| Diethylene glycol | 15 parts |
| Ion-exchanged water | 54 parts. |
| Magenta ink: | |
| C.I. Reactive Red 226 | 9 parts |
| Thiodiglycol | 20 parts |
| Diethylene glycol | 10 parts |
| Ion-exchanged water | 61 parts. |
| Yellow ink: | |
| C.I. Reactive Yellow 95 | 9 parts |
| Thiodiglycol | 20 parts |
| Diethylene glycol | 15 parts |
| Ion-exchanged water | 56 parts. |
| Black ink: | |
| C.I. Reactive Black 39 | 13 parts |
| Thiodiglycol | 20 parts |
| Ethylene glycol | 15 parts |
| Ion-exchanged water | 52 parts. |

After completion of the printing, the printed cloth was immediately subjected to a steaming treatment at 102° C. for 8 minutes, washed with water and then dried. As a result, a color image having depth in color and a sufficient color value was clearly printed on the cotton cloth. The print thus obtained was free of any image irregularities and had no stain on its white portion to which no ink was applied.

EXAMPLE 9

A pretreatment agent was prepared by using 2.0 parts of the sodium hippurate, 1.0 part of sodium alginate and 97.0 parts of water. A polyester cloth having a thickness of 200 μm was subjected to a padding treatment (pickup: 70%) with this pretreatment agent and then dried to obtain a cloth according to this example.

The thus-obtained cloth was cut into a rolled cloth 42 cm broad. Full-color printing was then performed on the thus-obtained rolled cloth by means of a commercially available ink-jet color printer (BJC-440, trade name, manufactured by Canon Inc.) and 4 kinds of inks having the following respective compositions and each containing a disperse dye. The four kinds of inks used were prepared by mixing and dispersing the respective components by means of a sand grinder and then filtering the dispersions through a filter.

| | |
|---|---|
| Cyan ink: | |
| C.I. Disperse Blue 87 | 6 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 58 parts. |
| Magenta ink: | |
| C.I. Disperse Red 92 | 5 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 59 parts. |
| Yellow ink: | |
| C.I. Disperse Yellow 93 | 5 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 59 parts. |
| Black ink: | |
| C.I. Disperse Black 1 | 6 parts |
| Sodium lignin sulfonate | 1 part |
| Sodium naphthalenesulfonate-formalin condensate | 10 parts |
| Thiodiglycol | 15 parts |
| Triethylene glycol | 10 parts |
| Ion-exchanged water | 58 parts. |

After completion of the printing, the printed portion was immediately cut out and subjected to a dyeing treatment for 7 minutes with superheated steam of 170° C. The thus-treated cloth portion was then subjected to reductive washing and water washing, and then dried. As a result, a color image having depth in color and a sufficient color value was clearly printed on the polyester cloth. The print thus obtained was sharp in image and had no stain on its white portion to which no ink was applied.

EXAMPLE 10

A polyester satin fabric (thickness of fiber: 0.8 denier) was subjected to a padding treatment (pickup: 90%) with the same pretreatment agent as that used in Example 9 and then dried to obtain a cloth according to the present invention. After this, the cloth was treated in exactly the same manner as in Example 9 to obtain a final print.

As a result, a color image having depth in color and a sufficient color value was clearly printed on the polyester satin fabric. The print thus obtained was sharp in image and had no stain on its white portion to which no ink was applied.

EXAMPLE 11

Two parts of pyrrolidone-5-carboxylic acid were mixed with 2.0 parts of triethanolamine, 3.0 parts of Paragium SS (trade name, paraffin type water repellent, product of Ohara Palladium KK), 0.2 parts of Acetylenol EH (trade name, nonionic surfactant, product of Kawaken Fine Chemicals Co., Ltd.), 2.5 parts of sodium hydrogencarbonate and 90.3 parts of water to obtain a pretreatment agent in the form of a solution. A plain weave cotton fabric was impregnated with this pretreatment agent (pickup: 90%) and dried to obtain a cloth according to this example. Multi-color printing was then performed on the thus-obtained cloth by means of the same commercially available ink-jet color printer (BJC-440, trade name, manufactured by Canon Inc.) as that used in Example 8 and the same inks as those used in Example 8. After completion of the printing, the printed cloth was immediately subjected to a dyeing treatment for 8 minutes with high temperature steam of 102° C., washed with water and then dried. As a result, an image higher in color value and sharper than the image in Example 8 was printed on the cotton cloth.

EXAMPLE 12

Two parts of pyrrolidone-5-carboxylic acid were mixed with 2.0 parts of triethanolamine, 1.0 part of sodium alginate, 0.2 parts of Acetylenol EH (trade name, nonionic surfactant, product of Kawaken Fine Chemicals Co., Ltd.), 2.0 parts of sodium hydrogencarbonate and 92.8 parts of water to obtain a pretreatment agent in the form of a solution. A silk cloth was subjected to a padding treatment (pickup: 90%) with this pretreatment agent and dried to obtain a cloth according to the present invention.

Multi-color printing was then performed on the thus-obtained cloth by means of the commercially available ink-jet color printer (BJC-440, trade name, manufactured by Canon Inc.) in the same manner as in Example 8. After completion of the printing, the printed cloth was immediately subjected to a dyeing treatment for 8 minutes with superheated steam of 102° C., washed with water and then dried. As a result, a color image, which was free of any irregularities and had depth in color and a sufficient color value, was clearly printed on the silk cloth. The print thus obtained was sharp in image and had no stain on its white portion to which no ink was applied.

Comparative Example 3

A cloth for textile printing was prepared in the same manner as in Example 8 except that pyrrolidone-5-carboxylic acid and triethanolamine were not used. Multi-color printing was then performed on the thus-obtained cloth by means of a commercially available ink-jet color printer (BJC-440, trade name, manufactured by Canon Inc.). After completion of the printing, the printed cloth was treated in the same manner as in Example 8 to obtain a print.

As a result, a color image having somewhat dull color tone compared with the print obtained in Example 8 was printed on the cotton cloth. Any color image having depth in color and a sufficient color value could not be obtained.

Comparative Example 4

A nylon cloth for textile printing was prepared in the same manner as in Example 7 except that pyrrolidone-5-carboxylic acid and triethanolamine in the pretreatment agent used in Example 1 were removed. Multi-color printing was then performed on the thus-obtained cloth by means of a commercially available ink-jet color printer (BJC-820J, trade name, manufactured by Canon Inc.). After completion of the printing, the printed cloth was treated in the same manner as in Example 7 to obtain a print.

As a result, an image printed on the nylon cloth lacked depth in color and had an insufficient color value compared with the image in Example 7.

As described above, the present invention permits the formation of clear images which are free of any bleeding and have depth in color and a high image optical density when the images are formed on cloth made of various kinds of fibers using an ink-jet printing apparatus.

According to the present invention, clear prints composed respectively of various kinds of fibers and having depth in color and a high color value can also be easily obtained by ordinary ink-jet printers coming into the market for office and personal uses.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A textile printing process comprising the steps of:

(i) providing a cloth comprising cotton or silk fiber and containing at least one substance selected from the group consisting of pyridine-3-carboxylic acid, dimethylglycine, bishydroxyethyltaurine, hippuric acid, glutamic acid, benzoyltaurine, alkali metal salts thereof and organic amine salts thereof on the surface of or in the interior of the cloth;

(ii) applying an ink comprising a reactive dye on the cloth by an ink-jet systems;

(iii) reacting the fiber with the dye in the ink applied on the cloth in step (ii); and (iv) washing the cloth resulting from step (iii).

2. The textile printing process according to claim 1, wherein step (iii) comprises a sub-step of heating or steaming the cloth to which the ink has been applied.

3. A printed cloth comprising cotton or silk fiber, containing a reactive dye and at least one substance selected from the group consisting of pyridine-3-carboxylic acid, bishydroxyethyltaurine, hippuric acid, benzoyltaurine, alkali metal salts thereof and organic amine salts thereof on the surface of or in the interior of the printed cloth.

4. The printed cloth according to claim 3, wherein the reactive dye is present in a discontinuous coating/pattern.

5. A process for alleviating bleed in a multi-color print on a cloth comprising cotton fiber or silk fiber, the multi-color print formed by a textile printing process comprising the steps of:

(i) applying an ink containing a reactive dye on the cloth by an ink-jet system;

(ii) reacting the dye in the ink applied on the cloth with the fiber; and (iii) washing the cloth resulting from step (ii);

wherein the cloth used in step (i) contains at least one substance selected from the group consisting of pyridine-3-carboxylic acid, dimethylglycine, bishydroxyethyltaurine, hippuric acid, glutamic acid, benzoyltaurine, alkali metal salts thereof and organic amine salts thereof on the surface of or in the interior of the cloth.

6. A printed cloth comprising cotton or silk fiber, containing a reactive dye and at least one substance selected from the group consisting of pyridine-3-carboxylic acid, bishydroxyethyltaurine, hippuric acid, benzoyltaurine, alkali metal salts thereof and organic amine salts thereof on the surface of or in the interior of the printed cloth, the cloth being obtained by a process comprising the steps of:

(i) providing the cloth;

(ii) applying to the cloth at least one substance from the group consisting of pyridine-3-carboxylic acid, bishydroxyethyltaurine, hippuric acid, benzoyltaurine, alkali metal salts thereof and organic amine salts thereof, and then drying the cloth; and (iii) applying an ink containing the reactive dye to the cloth resulting from step (ii).

* * * * *

UNITED STATES PATENT AND TRADEMARK OFFICE

CERTIFICATE OF CORRECTION

PATENT NO. : 6,200,667 B1
DATED : March 13, 2001
INVENTOR(S) : Masahiro Haruta et al.

It is certified that error appears in the above-identified patent and that said Letters Patent is hereby corrected as shown below:

Title page,
Item [56] FOREIGN PATENT DOCUMENTS:
"2031469 4/1980 (GB)" should read -- 2031469A 4/1980 (GB) --.

Column 14,
Line 31, "systems;" should read -- system; --.

Signed and Sealed this

Fourth Day of December, 2001

*Attest:*

Nicholas P. Godici

*Attesting Officer*

NICHOLAS P. GODICI
*Acting Director of the United States Patent and Trademark Office*